United States Patent [19]

Frye

[11] 3,992,790

[45] Nov. 23, 1976

[54] SNOW SHOE HARNESS

[75] Inventor: Jule B. Frye, Valemount, Canada

[73] Assignee: The Raymond Lee Organization, Inc., a part interest

[22] Filed: Oct. 21, 1975

[21] Appl. No.: 624,537

[52] U.S. Cl. ..... 36/125

[51] Int. Cl.[2] ..... A43B 5/04

[58] Field of Search ..... 36/2.5 AA, 2.5 AB, 122, 36/123, 124, 125

[56] References Cited

UNITED STATES PATENTS 375,522 12/1887 Woodbury ..... 36/2.5 AB 2,738,596 3/1956 Walsh ..... 36/2.5 AB

*Primary Examiner*—Patrick D. Lawson

[57] ABSTRACT

A harness adapted to secure the boot of a user to a snow shoe in such manner that the toe of the boot is pivotally secured to the shoe and the heel of the boot is free to move vertically relatively to the shoe whereby increased mobility is attained and less effort is required for use.

1 Claim, 3 Drawing Figures

SNOW SHOE HARNESS

SUMMARY OF THE INVENTION

Conventionally, in order to use snow shoes, the boots of the user are firmly secured both at toe and heel to the snow shoes whereby the shoes form lateral and longitudinal flat extensions of the bottom of the boots. This hinders mobility and requires considerable effort in walking on snow.

In this invention, the user of snow shoes has substantially increased mobility and can walk with much less effort. To this end, two harnesses are provided, each harness being used to secure a corresponding boot to a corresponding snow shoe.

Each harness employs a flat elongated bottom member engaging the underside of the sole of the shoe. First means pivotally secures the front end of the member to strands of the corresponding snow shoe. Second means detachably secures the member to the boot, the second means engaging the opposite side edges of the member and including a strap. The strap is secured at spaced points to the rear end of the member and extends along the sides of the boot and around the rear periphery at the heel of the boot.

As a result, the toe of the user's boot is pivotally secured to the corresponding snow shoe while the boot is otherwise free to move vertically with respect to the snow shoe. This arrangement yields the advantages previously described.

DETAILED DESCRIPTION OF PREFERRED EMBODIMENTS

Figure 1:
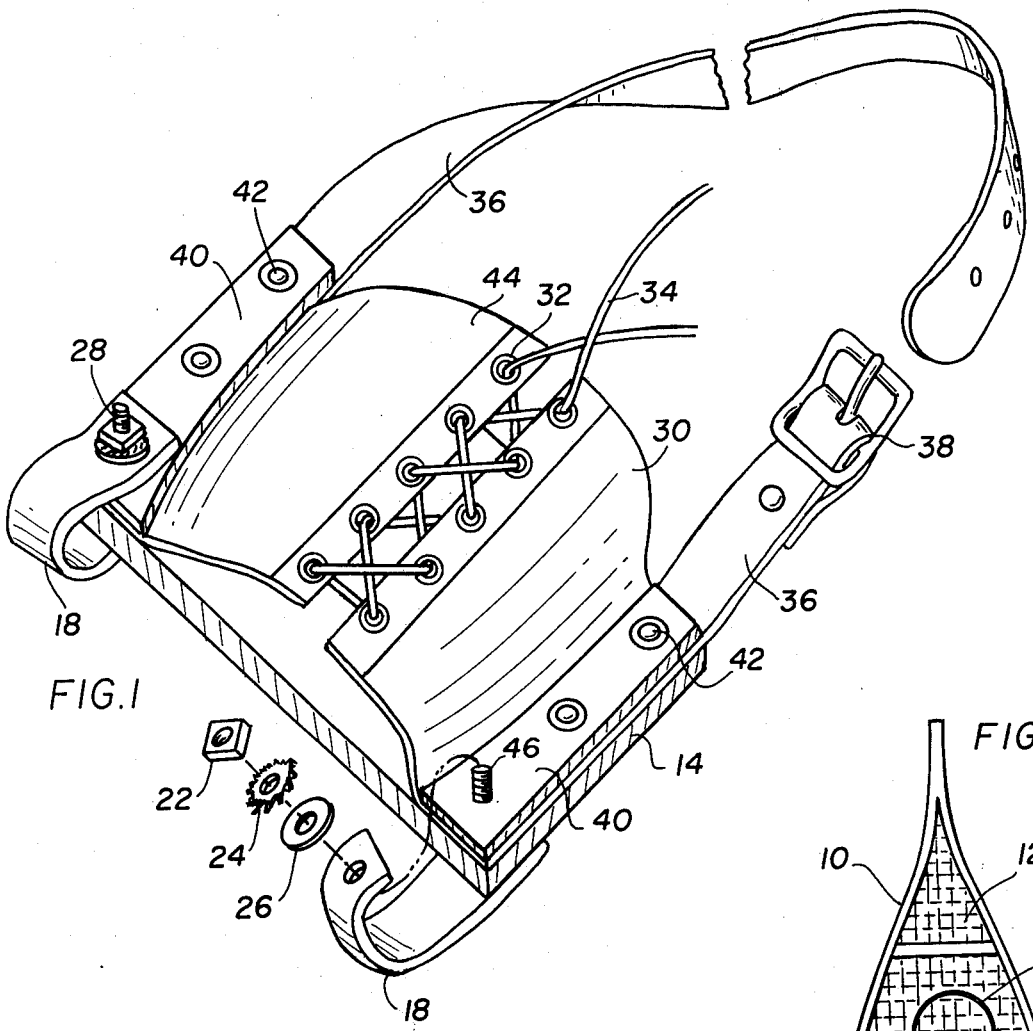
FIG. 1 is a perspective view of a snow shoe harness in accordance with the invention.
Figure 2:
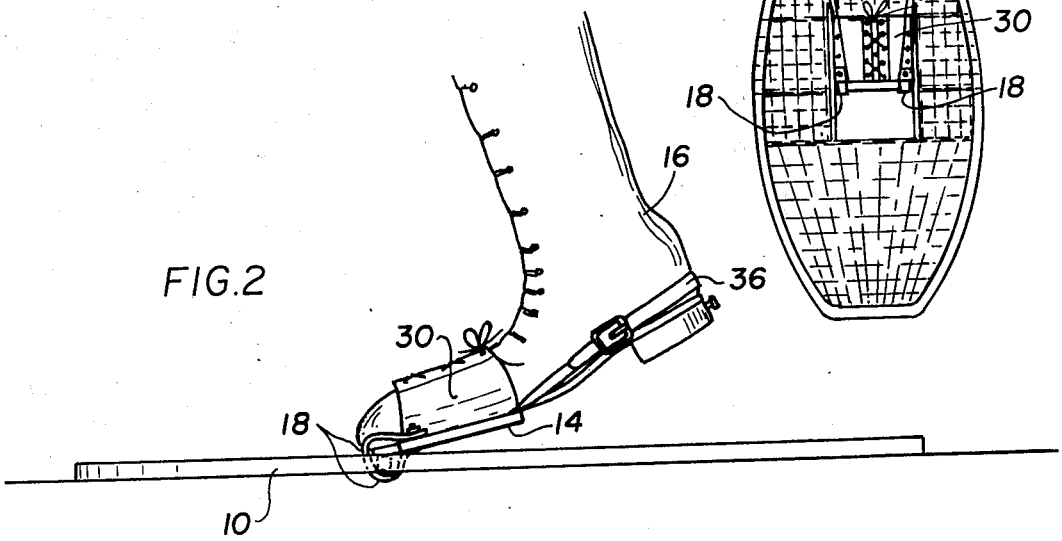
FIG. 2 is a side view of the invention in use.
Figure 3:
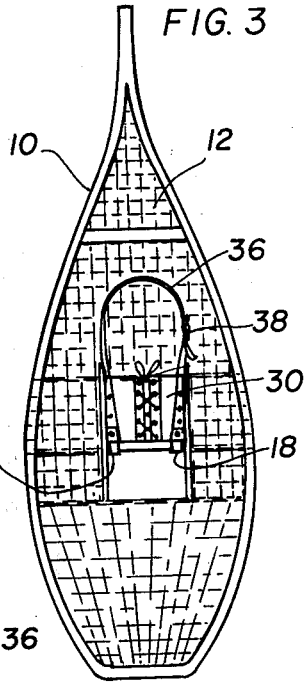
FIG. 3 is a top view of the invention in use.

Referring now to FIGS. 1–3, snow shoe 10 has strands 12. A harness for use with each shoe employs a flat elongated retangular member 14 formed of belting material or the like which can be typically from one-eighth to one quarter inches thick and is durable and flexible. This member is to be disposed underneath the sole of the boot 16 of the user, with a front edge spaced somewhat behind the toe of the boot, the rear edge of the member disposed adjacent but in front of the arch of the foot, the two opposite edges of the member extending somewhat beyond the adjacent sides of the sole.

At each corner of the front edge of the member there is disposed a corresponding strong durable flexible loop

18 (which can be formed of spring steel or other metal) detachably engaging a selected transverse strand 12 and secured to the member by a nut 22, lock washer 24, washer 26 and bolt 46 extending through a corresponding hole in the member. This pivotally secures the member at the front edge to the shoe.

First and second sections 44 and 30, thinner than the member and more flexible but also formed of leather are used to secure the member to the boot. To this end these sections have adjacent sides with metal eyelets 32 detachably interconnected by lacing 34. The opposite sides of these sections are secured to the corresponding side edges of the member as described below whereby the harness receives and holds the front portion of the boot.

Two strap lengths 36 detachably connected by a buckle 38 are each integral with a corresponding section 28 or 30 at a corresponding rear corner and extend along corresponding of the sole and wrap around the exposed rear periphery at the heel of the boot to insure that the harness is held firmly on the boot. Elongated strips 40 of spring steel or the like overlie the corresponding opposite sides of the sections. Rivets 42 extend transversely through strips, sections and member to hold same securely together. Bolts 46 extend through strips, sections and member to hold the loops in place.

What is claimed is:

1. A harness adapted to secure the boot of a user to a snow shoe in such manner as to allow increased mobility and reduced effort in walking, said device comprising:

a flat elongated bottom member engaging the underside of the sole of the boot;

two forwardly extending loops attached to the front end of the member and pivotally securing the front end of the member to strands of the snow shoe; and means detachably securing the member to the boot, the means including a strap that is secured along the entire length of each of the side edges of the member and is further secured at spaced points to the rear end of the member and that extends along the sides of the boot and around the rear periphery of the heel of the boot, to means further including two flexible thin sections having adjacent sides laced detachably together with the opposite side of each section being integral with the corresponding portion of the strap, and the means still further including first and second strips each strip overlying the corresponding opposite side of the corresponding section, the strips, sections and member being secured transversely together.

* * * * *